US007735160B1

(12) United States Patent
Schiebl

(10) Patent No.: US 7,735,160 B1
(45) Date of Patent: Jun. 15, 2010

(54) CHIN GUARD APPARATUS FOR USE WITH A HELMET

(76) Inventor: Paul Schiebl, 1513 Story St., Houston, TX (US) 77055

( * ) Notice: Subject to any disclaimer, the term of this patent is extended or adjusted under 35 U.S.C. 154(b) by 1271 days.

(21) Appl. No.: 11/222,283

(22) Filed: Sep. 8, 2005

Related U.S. Application Data

(63) Continuation-in-part of application No. 10/463,774, filed on Jun. 16, 2003, now abandoned.

(51) Int. Cl.
*A63B 71/10* (2006.01)

(52) U.S. Cl. ..... 2/425

(58) Field of Classification Search ..... 2/411, 2/414, 425, 412, 417, 418, 421
See application file for complete search history.

(56) References Cited

U.S. PATENT DOCUMENTS

| | | | | |
|---|---|---|---|---|
| 3,729,744 | A | | 5/1973 | Rappleyea |
| 3,935,044 | A | | 1/1976 | Daly |
| 4,075,717 | A | | 2/1978 | Lemelson |
| 4,282,610 | A | | 8/1981 | Stiegerwald et al. |
| 4,831,668 | A | | 5/1989 | Schulz |
| 5,090,061 | A | | 2/1992 | Kamata |
| 5,546,609 | A | | 8/1996 | Rush, III |
| 5,584,076 | A | | 12/1996 | Armstrong |
| 5,621,922 | A | | 4/1997 | Rush, III |
| 5,794,271 | A | | 8/1998 | Hastings |
| 5,826,281 | A | * | 10/1998 | Rush, III ..... 2/421 |
| 6,079,053 | A | | 6/2000 | Clover, Jr. et al. |
| 6,117,176 | A | | 9/2000 | Chen |
| 6,138,284 | A | | 10/2000 | Arai |
| 6,256,797 | B1 | | 7/2001 | Nemoto et al. |
| 6,298,483 | B1 | | 10/2001 | Schiebl et al. |
| 6,499,147 | B2 | * | 12/2002 | Schiebl et al. ..... 2/425 |
| 2004/0003452 | A1 | | 1/2004 | Schiebl |
| 2004/0191446 | A1 | | 9/2004 | Kriesel |

* cited by examiner

*Primary Examiner*—Tejash Patel
(74) *Attorney, Agent, or Firm*—Egbert Law Offices PLLC

(57) ABSTRACT

A chin guard apparatus has a shell having a cup suitable for fitting upon a human chin, a resilient layer received within in the cup of the shell and having a periphery overlying an outer peripheral edge of the shell, a first strap affixed to one side of the shell and extending outwardly therefrom, and a second strap affixed to an opposite side of the shell and extending outwardly therefrom. A bladder is affixed to a surface of the resilient layer opposite the shell. Strap splitters are associated with each of the first and second straps so as to allow portions of the strap to be attached to different hook-ups of the helmet.

14 Claims, 5 Drawing Sheets

CHIN GUARD APPARATUS FOR USE WITH A HELMET

RELATED U.S. APPLICATIONS

The present application is a continuation-in-part of U.S. patent application Ser. No. 10/463,774, filed on Jun. 16, 2003, and entitled "Helmet Chinstrap", presently pending.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to chin guards for use with helmets. More particularly, the present invention relates to chin guards that have protective cups associated therewith for protection of the chin of the wearer. More particularly, the present invention relates to chin guards apparatus whereby the chin strap can be selectively attached to different hookup points of the helmet. Additionally, the present invention relates to bladders that can be selectively filled with a fluid so as to adapt to the needs of the wearer.

BACKGROUND OF THE INVENTION

The invention relates to improvements in protective headgear such as football helmets, motorcycle and bicycle helmets, and helmets for other activities where protection from head impact and injury is desirable. The invention also relates to protective pads, particularly chin pads.

Protective helmets to minimize head injuries have been known and used for many years. For example, football helmet shells have been produced from injection molded ABS, or polycarbonate plastic. Helmets intended for youth usage have usually been produced from ABS plastic, and helmets for adult usage have usually been produced from polycarbonate plastic. ABS plastic is significantly less expensive than polycarbonate, but ABS plastic is not as structurally rigid as polycarbonate. As the level of intensity of contact in youth football is significantly lower than that at the adult level, ABS has been accepted as a satisfactory material for use at the youth level. For adult helmets, however, the structural rigidity of the polycarbonate material is essential to minimize the flex and deformation of the shell under extreme impact conditions.

The National Operating Committee on Standards for Athletic Equipment (NOCSAE) has been responsible for setting minimal performance criteria for football helmets. The minimum standard acceptance level measured by the Severity Index (SI) is set at 1200. Through the continuous testing of NOCSAE, it has been established that the rigidity of polycarbonate shells, in comparison to ABS shells, leads to significantly lower IS results. From these tests, it is believed that there is a correlation between the rigidity of the shell material and improved safety performance.

Protection can also be improved by the addition of a face mask attached to the helmet. For example, football helmets are usually equipped over the exposed face area with a vinyl coated wire or other metal structure, or an injection molded plastic face mask. The obvious purpose of the face mask is to protect the face of the player from injury, while not obstructing the players' vision unnecessarily. The addition of a face mask can also increase the rigidity of the shell which improves the SI performance. Helmets are usually tested without face masks so that the SI performance of a helmet with the mask will somewhat exceed the test standard.

Face masks have been mounted to the exterior surface of the helmet shell behind the front edge of the helmet face opening. This design can, under certain conditions, contribute to serious injury. Helmet shells are specifically designed with smooth spherical surfaces to allow the shells to glance and slide on impact. The mounting of the face mask on the outer surface creates the potential that the masks of two players hitting could become engaged as their helmets are glancing, changing the directional forces and causing the potential for serious injury.

Protective helmets usually include a chin strap to hold the helmet on, particularly during impact. In the past, chin straps were frequently constructed using a molded plastic cup made of compression or injection-molded plastic material. A pad, usually of a felt or foam material, was bonded or otherwise attached to the plastic cup. This cup construction is preferable to non-padded chin straps which have been standard equipment on football helmets. Non-padded chin straps do not offer any impact protection to the chin area, and only serve to secure the helmet to the player's head. Padded chin cups provide an added measure of protection to the chin from impacts, in addition to securing the helmet to the player's head.

Improvement in the impact absorption performance of padded chin straps is desirable. Most molded plastic chin cups currently used are molded in a manner which allows the formed cup to flex upon impact. An improved construction is a rigid material which does not flex on impact to an undesirable degree, thus distributing the impact force over a larger area of the chin.

One key to improved SI performance is related to the stiffness of the protective shell. The invention provides helmet shells which can increase the rigidity of the shell, resulting in improved SI performance. An additional and significant benefit can be a substantial reduction of weight in comparison to the current plastic shells being produced. These same methods and structures may be applied to protective headgear other than football helmets, and to chin cups.

The present inventor is one of the inventors of U.S. Pat. No. 6,298,493, issued on Oct. 1, 2001 to Schiebl et al. U.S. Pat. No. 6,298,493 describes a protective headgear that comprises a rigid shell with face pads that can be released and removed while the headgear is still on a person's head. A protective chin guard is attached to the headgear by way of the face pads. The chin guard includes a substantially rigid shell with a removable insert made of a flexible bladder filled with a shock-absorbing fluid. The headgear includes a shell made of an inner and outer material layered over an internal foam core to effect both strength and light weight.

Existing chin straps are usually separately prepared for attachment to either the high hookup or the low hookup of a football helmet. The user of the football helmet will often desire that the chin strap have different orientations to fit the desires of the wearer and the configuration of the face of the wearer. Additionally, whether the wearer uses a high hookup or a low hookup will depend upon the desired amount of protective performance desired from the chin strap. Unfortunately, conventional chin straps cannot be interchangeably adapted to the high hookup or the low hookup configurations.

In other circumstances, the cup associated with the protective shell of the chin strap has an imperfect fit with the wearer's chin. In certain circumstances, the user may desire to have enhanced protection against impacts. The wearer may desire a more comfortable fit with the cup of the shell of the protective chin strap. Existing chin straps do not offer the degree of adjustability desired by the user so as to fit the performance and comfort goals of the user.

Often, the cup of the chin strap has a peripheral edge which bears against the skin of the user. In the event of an impact, this edge can bruise the chin of the user. In the event of a severe impact, the peripheral edge of the protective shell of the chin strap can cause adverse impacts to the face of the user. As such, a need has developed whereby the edge of the shell of the cup of the chin strap be fully cushioned and protected from the skin of the wearer.

It is an object of the present invention to provide a chin guard apparatus which maximizes the protection and comfort of the user.

It is another object of the present invention to provide a chin strap apparatus which enhances the degree of protection against the peripheral edge of the rigid shell of the cup of the chin guard apparatus.

It is a further object of the present invention to provide a chin guard apparatus which allows the user to adapt between different hookup points of the helmet.

It is a further object of the present invention to provide a chin guard apparatus whereby the cushion of the cup can be adapted to properly fit the facial configuration and desires of the user.

It is another object of the present invention to provide a chin guard apparatus that enhances shock absorption on the exterior surface of the protective shell of the chin guard.

It is still a further object of the present invention to provide a chin guard apparatus to provide air circulation with the skin of the user.

It is still a further object of the present invention to provide a chin guard apparatus whereby the straps associated with the apparatus can display team indicia and/or advertising.

These and other objects and advantages of the present invention will become apparent from a reading of the attached specification and appended claims.

BRIEF SUMMARY OF THE INVENTION

The present invention a chin guard apparatus for use with a helmet. This chin guard apparatus includes a shell having a cup suitable for fitting upon a human chin, a resilient layer received within in the cup of the shell, a first strap affixed to one side of the shell and extending outwardly therefrom, and a second strap affixed to an opposite side of the shell and extending outwardly therefrom. The shell has an outer peripheral edge. The resilient layer has a periphery overlying the outer peripheral edge of the shell. The first and second straps are suitable for attachment to the helmet.

In the present invention, the outer peripheral edge of the shell is flanged outwardly away from the cup. The periphery of the resilient layer extends over and beyond this outer peripheral edge. In the preferred embodiment of the present invention, the shell is formed of a rigid polymeric material while the resilient layer is formed of a foamed polymeric material.

In one embodiment of the present invention, a bladder can be affixed to a surface of the resilient layer opposite the shell or directly to the shell. This bladder is filled at least partially with a fluid. In particular, the bladder may be selectively fillable with fluid. In this configuration, a valve means communicates with the bladder so as to allow a pump to selectively fill the bladder with fluid. The shell and the resilient layer have a hole formed therethrough. This valve means extends through the hole so as to have an inlet of the valve at an outer surface of the shell.

In the present invention, the shell has a slot formed generally centrally thereof. A shock absorber is affixed within this slot. The shock absorber is of a material that is more resilient than a resiliency of a material of the shell.

The present invention has a first strap splitter through which the first strap extends and a second strap splitter through which the second strap extends. Each of the first and second strap splitters includes a body having a first slot in spaced relationship to a second slot. The body has a bar between the slots. The second slot has a length that is greater than the first slot. The strap has a first portion and a second portion. Each of the first and second portions extends through first and second slots and over the bar. The second slot is suitable for allowing one of the first and second portions to be attachable to either a high hookup or a low hookup of the helmet. Each of the first and second slots are in the form of an arcuate slot. The body has a button element positioned over and adjacent to the first slot.

Each of the first and second straps includes a fabric strap that is encased in a polymeric material. The polymeric material may be suitably translucent or transparent so as to expose the fabric strap therethrough. This fabric strap can be formed of a natural or synthetic material. The strap can have team indicia, advertising indicia or other information printed thereon so that this information is visible through the polymeric covering. The polymeric covering of the strap can be of a desired color.

The resilient layer can be directly affixed to the rigid shell. The resilient layer can be a non-viscous gel material.

DETAILED DESCRIPTION OF THE INVENTION

Figure 1:
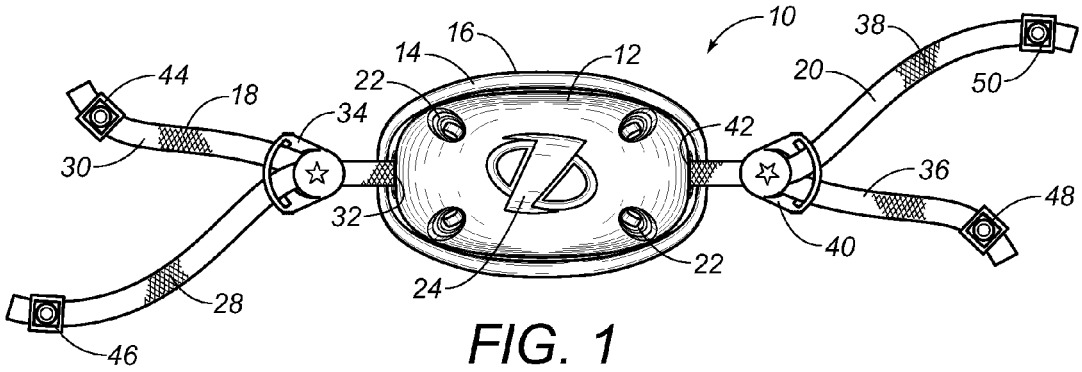
FIG. 1 is a front elevation view showing the chin guard apparatus in accordance with the preferred embodiment of the present invention.

Referring to FIG. 1, there is shown the chin guard apparatus 10 in accordance with the preferred embodiment of the present invention. The chin guard apparatus 10 includes a shell 12 that has a cup-shape which is suitable for fitting upon a human chin. The shell 12 includes an outer peripheral edge. A resilient layer 14 is received within the shell. The resilient layer 14 has an outer periphery 16 that overlies the outer peripheral edge of the shell 12. A first strap 18 is affixed to one side of the shell 12 and extends outwardly therefrom. The first strap 18 is suitable for attachment to a helmet. A first strap 20 is affixed to an opposite side of the shell 12 and extends outwardly therefrom. This second strap 20 is also suitable for attachment to another location on the helmet.

As can be seen in FIG. 1, the shell 12 has a cup-shape with a plurality of holes 22 formed therethrough. The holes 22 are configured so as to allow air to circulate into the interior of the cup-shape of the shell 12. This feature improves air circulation with the skin of the user so as to avoid rashes and skin discomfort.

The shell 12 has a shock absorber 24 located generally centrally thereof. The shock absorber 24 is affixed within a slot formed on the exterior surface of the shell 12. The shock absorber 24 will have a resiliency which is greater than the resiliency of the remainder of the shell 12. As a result, any direct impacts onto the central portion of the shell 12 are effectively absorbed, dispersed and/or distributed.

An air valve 26 is located in a hole formed in the shell 12 adjacent to the shock absorber 24. The air valve 26 communicates with a bladder located on the interior of the shell 12 and the resilient layer 14. As such, the user can apply a pump to this valve 26 so as to introduce air (or possibly a liquid) into a bladder located on the interior of the shell 12.

A rigid layer 12 is formed of a rigid polymeric material, such as a polycarbonate material. The resilient layer 14 is generally of a foamed polymeric material. The resilient layer 14 has a periphery that extends over and beyond the outer peripheral edge of the shell 12. The resilient layer 14 provides some shock absorption in combination with the shell 12. In other words, the rigid nature of the shell 12 will tend to resist impacts and distribute the force of the impact. The resilient layer 14 would absorb any shocks applied to the rigid shell 12. The resilient layer can be formed of a non-viscous gel.

In FIG. 1, it can be seen that the first strap 18 include a first strap portion 28 and a second strap portion 30. These strap portions extend through a slot 32 formed through the shell 12 on one side of the shell 12. A strap splitter 34 is positioned on the portions 28 and 30 so as to allow the portions 28 and 30 to be respectively affixed to desired locations on a football helmet. The second strap 20 also has a similar configuration as the first strap 18 with a first portion 36 and a second portion 38. The strap splitter 40 allows the portions 36 and 38 to be affixed to respective connections on the football helmet. The strap 20 passes through a slot 42 formed on an opposite side of the shell 12. A snap 44 is secured to the portion 30 of strap 18. A snap 46 is secured to the portion 28 of strap 18. A snap 48 is secured to the portion 36 of strap 20. Similarly, a snap 50 is secured to the portion 38 of strap 28. Snaps 44, 46, 48 and 50 are suitable for being secured onto the hookups of a football helmet.

Figure 2:
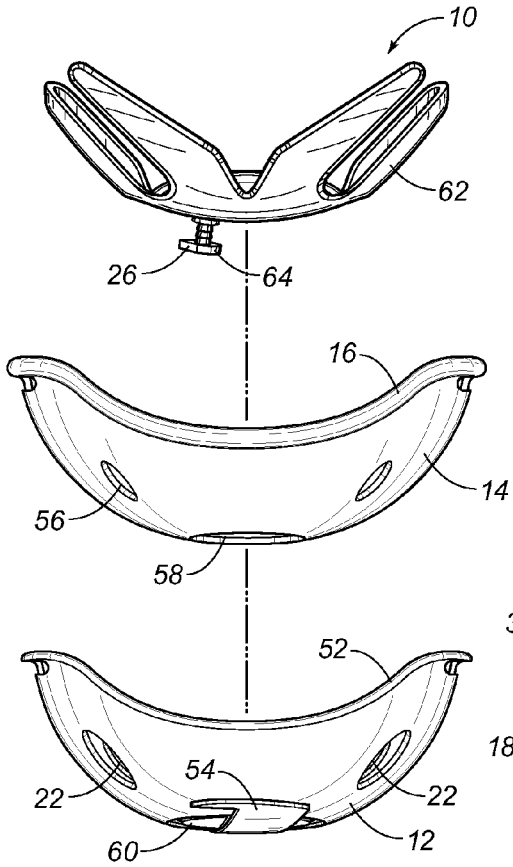
FIG. 2 is an exploded view showing the chin guard apparatus of the present invention.

FIG. 2 is an exploded view of the chin guard apparatus 10 of the present invention. In FIG. 2, it can be seen that the shell 12 has a generally cup-shape and an outer peripheral edge 52. The shell 12 includes holes 22 which facilitate air circulation into the interior of the cup shape of the shell 12. A slot 54 is formed centrally of the shell 12. Slot 54 is configured so as to allow for the receipt of a shock absorber therein.

The resilient layer 14 also has a cup-shape and is positioned substantially in the interior of the shell 12. Resilient layer 14 also has holes 56 which are aligned with the holes 22 on the shell 12. A central opening 58 is formed in the resilient layer 14 so as to align with the openings 60 located on opposite sides of the slot 54. The resilient layer 14 has a periphery 16 which will overlie the outer peripheral edge 52 of the shell 12. It can be seen that the outer peripheral edge 52 of the shell 12 is flanged outwardly from the remainder of the shell 12. The periphery 16 of the resilient layer 14 should have a sufficient size so as to completely overlie and extend over and beyond the outer peripheral edge 52 of the shell 12. As such, any impacts applied upon the surface of the shell 12 will be absorbed by the resilient layer 14 at the outer periphery 16. This will prevent any damaging direct contacts between the rigid outer peripheral edge 52 of the shell 12 and the face of the user.

In FIG. 2, it can be seen that there is a bladder 62 that is be positioned on the interior of the resilient layer 14 and on the interior of the shell 12. Bladder 62 has a general configuration similar to that described in U.S. Pat. No. 6,298,483 by the present inventor. However, it can be seen that the bladder 62 includes a valve 26 that communicates with the interior of the bladder 62. Valve 26 will extend through the hole 58 and into one of the openings 60 on opposite sides of the slot 54 of the shell 12. As a result, the end face 64 of the valve 26 will be exposed on the exterior of the shell 12. When a suitable needle is inserted into the valve 26, an air pump can be used so as to inflate and/or deflate the interior of the bladder 62. As a result, the present invention allows the chin guard apparatus 10 of the present invention to be suitably adapted to various shapes and sizes of human chins while providing a desired degree of comfort and protection to the user.

Figure 3:
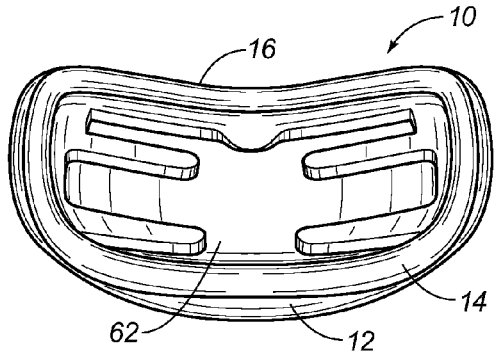
FIG. 3 is an interior view of the chin cup as used in the chin guard apparatus of the present invention.

FIG. 3 shows the interior of the chin guard apparatus 10. The outer periphery 16 of the resilient layer 14 will overlie the outer peripheral edge 52 of the shell 12. The bladder 62 is affixed into the interior of the resilient layer 14. The bladder 62 includes finger elements which extend longitudinally outwardly from a central portion. As was described in U.S. Pat. No. 6,298,483, this configuration provides enhanced protection and comfort to the user.

Figure 4:
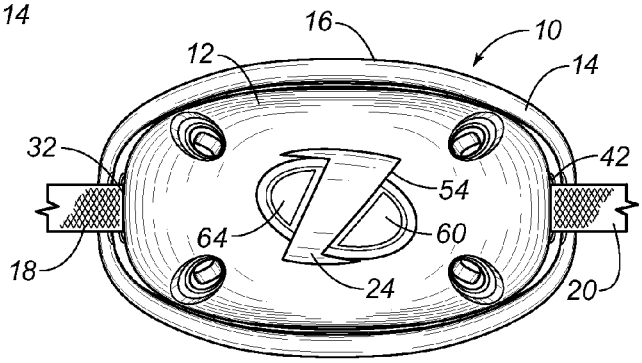
FIG. 4 is a frontal view showing the chin cup of the chin guard apparatus of the present invention.

FIG. 4 illustrates the face of the chin guard apparatus 10 of the present invention. In FIG. 4, it can be seen how the outer periphery 16 of the resilient layer 14 overlies the outer peripheral edge 52 of the shell 12. The shock absorber 24 is affixed within the slot 54 located centrally of the shell 12. The valve face 64 is exposed through one of the openings 60 on one side of the shock absorber 24. The first strap 18 is illustrated as extending the slot 32 of the shell 12. The second strap 20 extends through the slot 42 of the shell 12.

Figure 5:
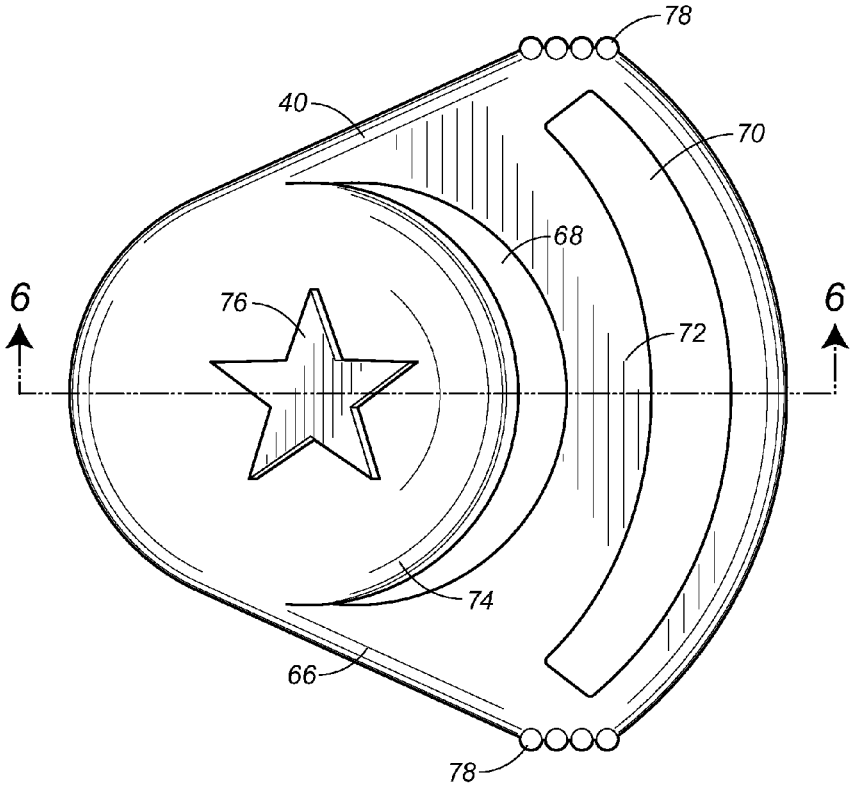
FIG. 5 is an isolated view of the strap splitter as used in the present invention.

A unique feature of the present invention is illustrated in FIG. 5. In particular, FIG. 5 shows the strap splitter 40. The strap splitter 40 is intended to allow the user conveniently to connect the strap portions 36 and 38 to either a high hookup or a low hookup of a football helmet. The strap splitter 40 includes a body 66 formed of a polymeric material. A first slot 68 opens through the body 66. A second slot 70 is in spaced relationship to the first slot 68 and also opens through the body. A bar 72 is formed between the slots 68 and 70. The slots 68 and 70 are configured so as to allow the strap portions 36 and 38 to pass therethrough and over the bar 72. The second slot 70 has a length that is greater than the first slot 68. Each of the first portion 36 and the second portion 38 will extend through the slots 68 and 70 and over the bar 72 so as to allow at least one of the portions 36 and 38 to be attached to either a high hookup or a low hookup of the helmet. A button element 74 is positioned over and adjacent to the first slot 68. An indicia 76 may be positioned on the exterior surface of the button element 74 for displaying a team logo, marketing and/or advertizing material, or any other information that the user may want to be visibly displayed. Gripping elements 76 and 78 are formed on the outer periphery of the strap splitter 40. The gripping elements 76 and 78 can be knurled surfaces so as to facilitate the ability of the user to grip the strap splitter 40 and move the strap splitter 40 along the strap 20, as desired.

Although FIG. 5 shows the strap splitter 40, the strap splitter 34 will have an identical configuration and can be used so as to receive the portions 28 and 30 of the strap 18 therethrough.

Figure 6:
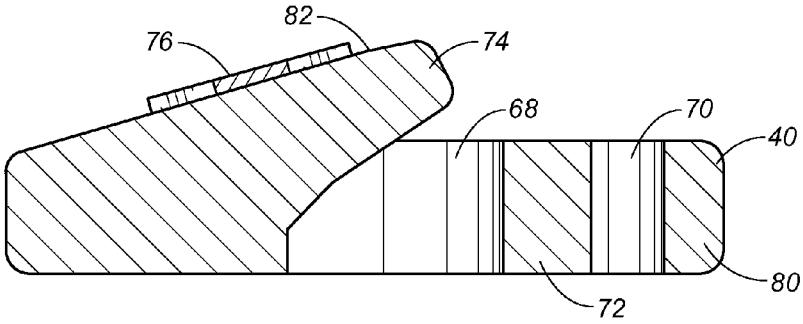
FIG. 6 is a cross-sectional view taken across lines 6-6 of FIG. 5 of the strap splitter of the present invention.

FIG. 6 is a cross-sectional view showing the configuration of the strap splitter 40. It can be seen that the first slot 68 is in spaced relationship to the second slot 70. The bar 72 extends between the slots 68 and 70. The button element 74 extends upwardly at an angle over the first slot 68 and generally adjacent to the bar 72. As such, the strap portions 36 and 38 can be easily threaded through the slot 68, over the bar 72 and back down through the slot 70 and under the end portion 80. The indicia 76 can be placed upon the face 82 of the button element 74.

Figure 7:
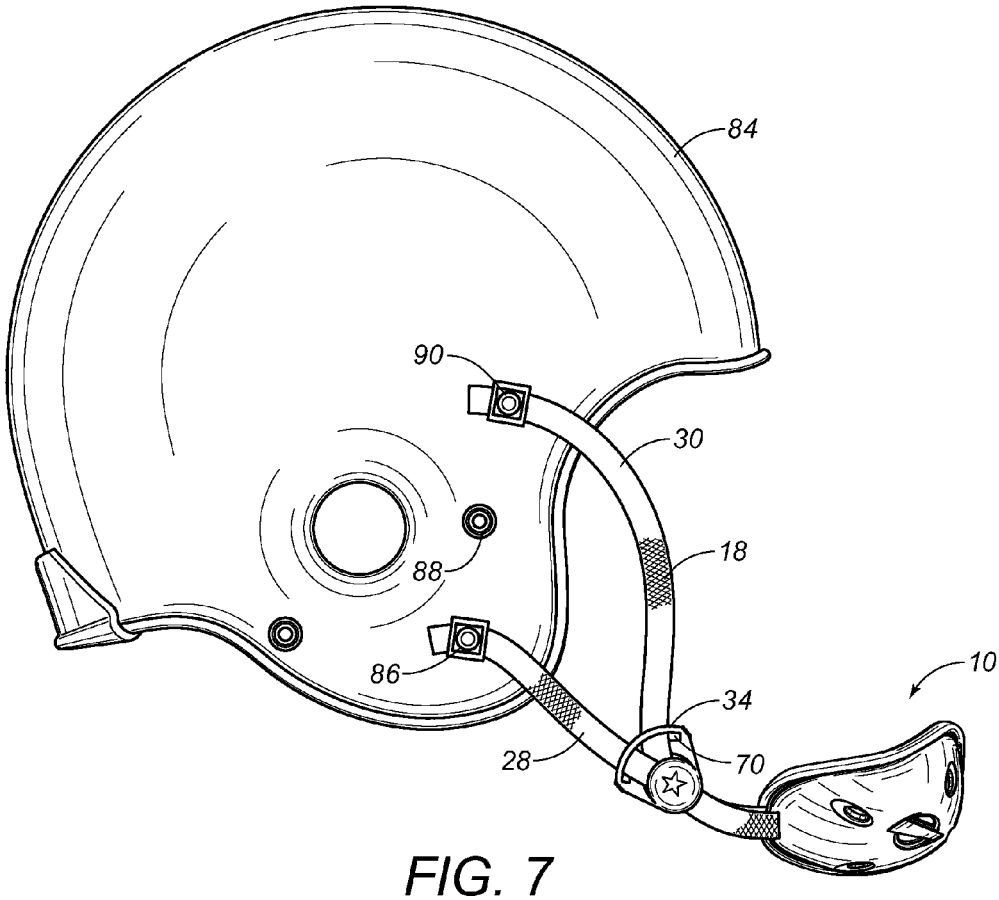
FIG. 7 is a side elevational view of the present invention showing the chin guard apparatus as applied to a high hookup of a football helmet.

FIG. 7 illustrates the application of the chin guard apparatus 10 of the present invention to a high hookup of a football helmet 84. It can be seen that the football helmet 84 has connections 86, 88 and 90 thereon. Strap 18 is individually illustrated with its portion 28 affixed in snap-fit relationship onto the connector 86. The portion 30 of strap 18 is secured to the high hookup connector 90. The strap 18 extends through the slot 70 of the strap splitter 34. Similarly, the portion also extends through the slot 70 of the strap splitter 34. The relatively long length of the slot enhances the ability of the strap 18 to angularly divert the portions 28 and 30 so as to achieve a high hookup configuration.

Figure 8:
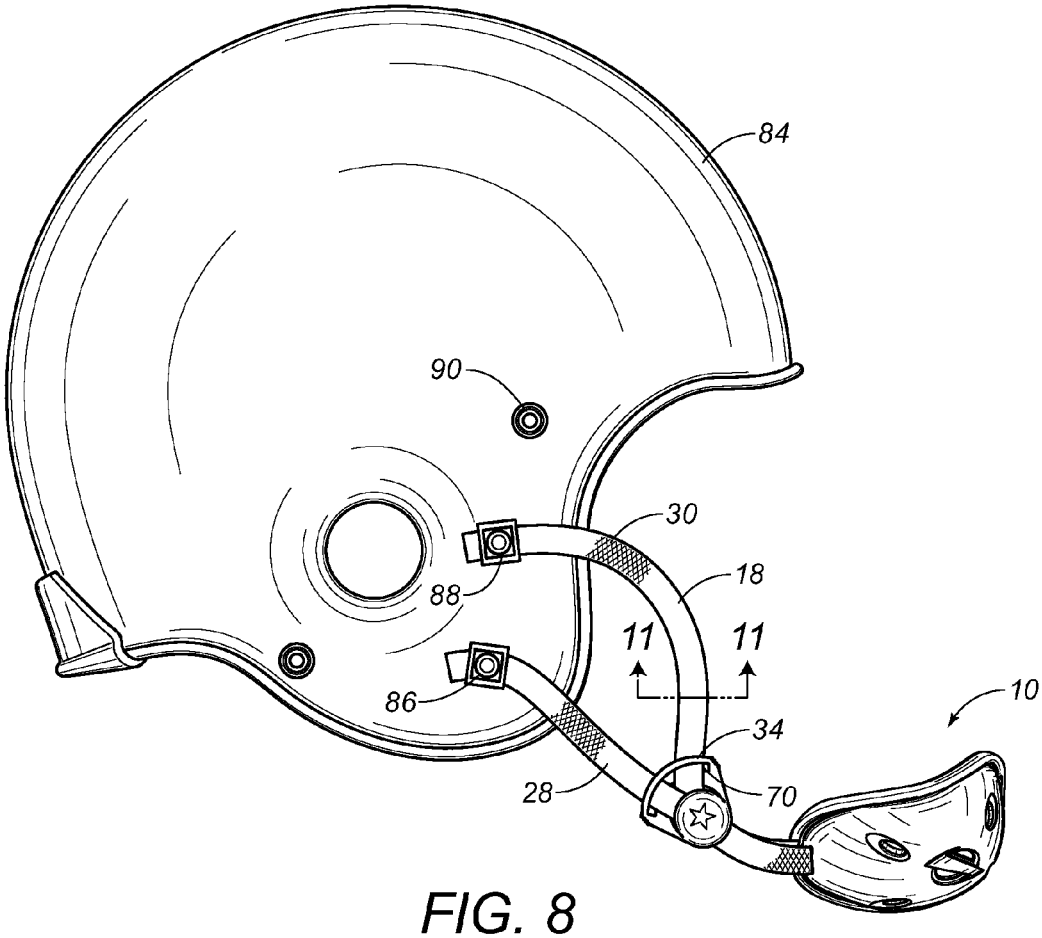
FIG. 8 is a side elevational view showing the chin guard apparatus of the present invention as applied to a low hookup of a football helmet.

FIG. 8 shows the strap 18 as configured for a low hookup on the football helmet 84. As can be seen, the portion 28 is also secured to the connector 86. The portion 30 is in snap-fit relationship with the low hookup connector 88 of the football helmet 84. The portions 28 and 30 are less angularly separated and are closer together within the slot 70 of the strap splitter 34.

The adaptability of the present invention allows the straps 18 and 20 to be used in association with either the high hookup or low hookup. It is not necessary for the football player to entirely replace the straps when he desires to move from a low hookup to a high hookup. Additionally, the present invention allows for only a single strap 18 and/or 20 to be used in association with the chin guard apparatus 10. Prior art arrangements often require two separate straps that extend in angularly different arrangements so as to achieve the desired high hookup or low hookup configuration of the strap.

Figure 9:
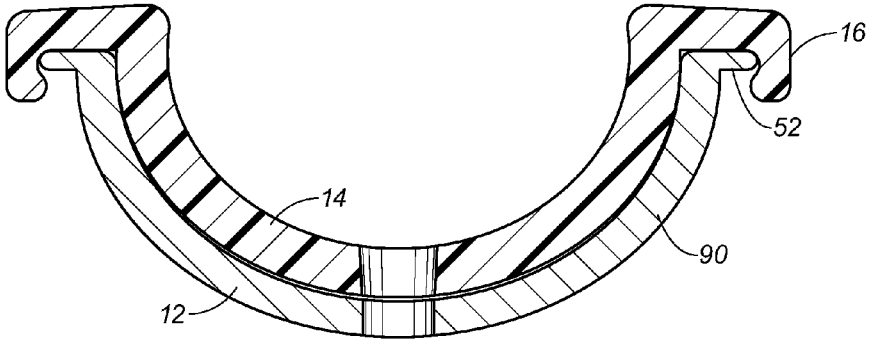
FIG. 9 is a cross-sectional view of the chin cup of the present invention.

FIG. 9 illustrates the manner in which the resilient layer 14 is received within the rigid shell 12. As can be seen, the outer peripheral edge 52 of the shell 12 is flanged outwardly from the remaining body 90 of the shell 12. The resilient layer 14 has a periphery 16 which will overlie the outer peripheral edge 52 and extend entirely thereover. As a result, any injurious contact between the rigid peripheral edge 52 of the shell 12 and the face of the user is effectively avoided no matter what type of impact is applied to the shell 12.

It should be noted that, within the concept of the present invention, the chin guard apparatus 10 can simply have the rigid shell 12 and the resilient layer 14 affixed to each other. In certain circumstances, the resilient layer 14 can be securely and integrally affixed to the interior surfaces of the shell during assembly at the factory. In other circumstances, the resilient layer 14 can have a different color or appearance than that of the shell 12 so as to allow assembly in remote locations.

Figure 10:
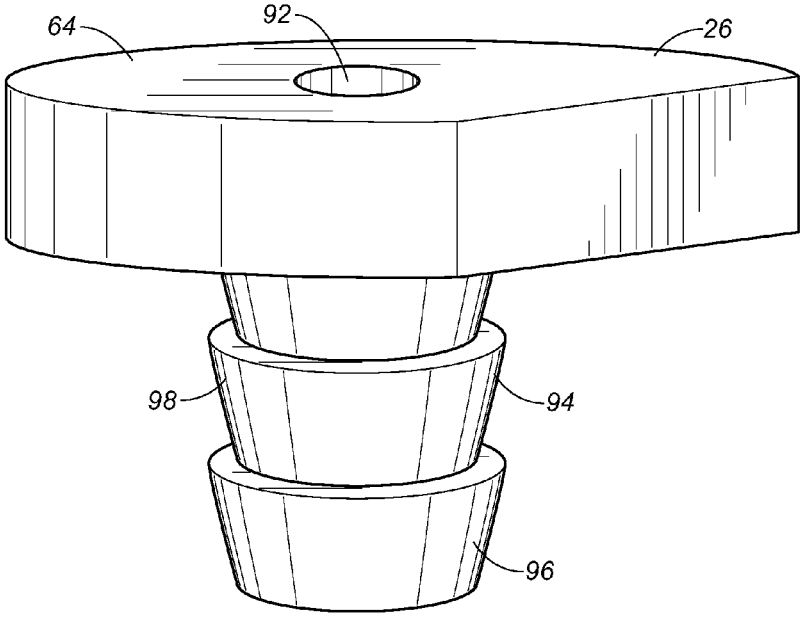
FIG. 10 is a perspective view showing the valve as used with the inflatable bladder associated with the chin guard apparatus of the present invention.

FIG. 10 is an isolated view of the valve connection 26 with the bladder 62. It can be seen that the valve 26 has a face 64 which generally conforms in shape to the opening 60 located adjacent to the shock absorber 54 on the shell 12. A hole 92 is formed through the interior of the valve 26 so as to extend downwardly through tubular connector 94. Tubular connector 94 can be inserted into an opening associated with the bladder 62. The frustoconical shape of the sections 96 and 98 of the tubular portion 94 ensure an air tight relationship between the valve 26 and the connector with the bladder 62. When a needle is inserted into the hole 92, interior surfaces within the hole 92 open so as to allow the needle to be inserted thereinto. As a result, an air pump can apply air through the hole 92 and into the interior of the bladder 62. When a sufficient amount of air has been applied into the interior of the bladder 62, the needle can slide outwardly through the hole 92 such that the interior surfaces on the interior of hole 92 will reunite so as to prevent escape of air through the valve 26.

Figure 11:
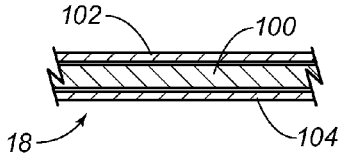
FIG. 11 is a cross-sectional view as taken across lines 11-11 of FIG. 8 showing the strap as used in the chin guard apparatus of the present invention.

FIG. 11 shows a cross-sectional view of the portion 30 of the strap 18. In FIG. 11, it can be seen that the strap 18 is configured with a fabric strip 100 encased between polymeric sides 102 and 104. The fabric strips 100 can be formed of a polymeric fabric material or a natural fabric material. The fabric strip 100 can be imprinted with team logos, marketing information, advertisements or other information. The polymeric layers 102 and 104 are suitably transparent and/or translucent so as to allow the information imprinted on the fabric strip 100 to be visible therethrough. It is believed that the appearance of the fabric strip enhances the aesthetic appeal of the strap 18. The encasing of the fabric strip 100 within the polymeric layers 102 and 104 ensures a long life for the strap 18 without deterioration or damage.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A chin guard apparatus for use with a helmet in which the helmet has a high hook-up and a low hook-up, the chin guard apparatus comprising:

a shell having a cup suitable for fitting upon a human chin, said shell having an outer peripheral edge, said shell having a single first strap-receiving slot adjacent one side of said shell and a single second strap-receiving slot adjacent an opposite side of said shell;

a resilient layer received within said cup of said shell, said resilient layer having a periphery overlying said outer peripheral edge of said shell;

a first strap extending through said first strap-receiving slot of said shell and extending outwardly therefrom, said first strap suitable for attachment to the helmet;

a second strap extending through said second strap-receiving slot of said shell and extending outwardly therefrom, said second strap suitable for attachment to the helmet; and a first strap splitter through which said first strap extends, said first strap splitter comprising a unitary body having a first slot in spaced relationship to a second slot, said first strap splitter having a fixed bar formed therewith and positioned between said first slot and said second slot, said second slot having a length that is greater than a length of said first slot, said first strap having a first portion and a second portion juxtaposed together in said first slot and angularly diverging from each in said second slot, said first portion and said second portion being angularly adjustable with respect to each other so as to allow one of said first and second portions to be attached to either the high hook-up or low hook-up of the helmet.

2. The apparatus of claim 1, said outer peripheral edge of said shell being flanged outwardly away from said cup, said periphery of said resilient layer extending over and beyond said outer periphery.

3. The apparatus of claim 1, said resilient layer being of a non-fluid gel material.

4. The apparatus of claim 1, further comprising:

a bladder affixed to or interconnected to said shell, said bladder being filled at least partially with a fluid.

5. The apparatus of claim 4, said bladder being selectively Tillable with a fluid, the apparatus further comprising:

a valve means communicating with said bladder for allowing a pump to selectively fill said bladder.

6. The apparatus of claim 5, said shell and said resilient layer having a hole formed therethrough, said valve means extending through said hole so as to have an inlet of said valve on an outer surface of said shell.

7. The apparatus of claim 1, said shell having a slot generally centrally thereof, the apparatus further comprising:

a shock absorber affixed within said slot, said shock absorber being of a material that is more resilient than a resiliency of a material of said shell.

8. The apparatus of claim 1, further comprising:

a second strap splitter through which said second strap extends.

9. The apparatus of claim 8, said second strap splitter comprising:

a unitary body having a first slot in spaced relationship to a second slot, said unitary body having a bar between said first and second slots, said second slot having a length that is greater than a length of said first slot, the strap having a first portion and a second portion, each of said first and second portions extending through said first and second slots and over said bar, said second slot suitable for allowing one of said first and second portions to be attachable to either the high hook-up or the low hook-up of the helmet.

10. The apparatus of claim 9, each of said first and second slots of said body being an arcuate slot, said body having a button element positioned over and adjacent to said first slot.

11. The apparatus of claim 1, each of said first and second straps comprising:

a fabric strap encased in a polymeric material, said polymeric material being suitably translucent so as to expose said fabric strap therethrough.

12. A chin guard apparatus for use with a helmet in which the helmet has a high hook-up and a low hook-up, the chin guard apparatus comprising:

a shell having a cup suitable for fitting upon a human chin, said shell having an outer peripheral edge;

a resilient layer received within in said cup of said shell;

a first strap affixed to one side of said shell and extending outwardly therefrom, said first strap suitable for attachment to the helmet;

a second strap affixed to an opposite side of said shell and extending outwardly therefrom, said second strap suitable for attachment to the helmet;

a first strap splitter through which said first strap extends, said first strap splitter comprising a unitary body having a first slot in spaced relationship to a second slot, said first strap splitter having a fixed bar formed therewith and positioned between said first slot and said second slot, said second slot having a length that is greater than a length of said first slot, said first strap having a first portion and a second portion juxtaposed together in said first slot and angularly diverging from each in said second slot, said first portion and said second portion being angularly adjustable with respect to each other so as to allow one of said first and second portions to be attached to either the high hook-up or low hook-up of the helmet; and a second strap splitter through which said second strap extends, said second strap splitter comprising a unitary body having a first slot in spaced relationship to a second slot, said second strap splitter having a fixed bar formed therewith and positioned between said first slot and said second slot, said second slot of said second strap splitter having a length that is greater than a length said first slot of said second strap splitter, said first strap having a first portion and a second portion juxtaposed together in said first slot of said second strap splitter and angularly diverging from each in said second slot of said second strap splitter, said first portion and said second portion of said second strap being angularly adjustable with respect to each other so as to allow one of said first and second portions of said second strap to be attached to either the high hook-up or low hook-up of the helmet.

13. The apparatus of claim 12, each of said first and second slots of said body of each of said first and second strap splitters being an arcuate slot, said body having a button element positioned over and adjacent said first slot.

14. The apparatus of claim 12, each of said first and second straps comprising:

a fabric strip encased in a polymeric material, said polymeric material being suitably translucent so as to expose said fabric strip therethrough.

* * * * *